US005181685A

United States Patent [19]

Ostapowicz

[11] Patent Number: 5,181,685

[45] Date of Patent: Jan. 26, 1993

[54] COLLAPSIBLE HANGER BAR

[76] Inventor: Vladimir Ostapowicz, 1782 Nisson Rd., #69, Tustin, Calif. 92680

[21] Appl. No.: 774,076

[22] Filed: Oct. 9, 1991

[51] Int. Cl.[5] ..... E04G 3/00

[52] U.S. Cl. ..... 248/293; 211/105.1; 211/123

[58] Field of Search ..... 248/293, 291, 240.4; 211/105.1, 105.2, 105.3, 123, 111, 99; 403/85

[56] References Cited

U.S. PATENT DOCUMENTS

| | | | |
|---|---|---|---|
| 1,306,846 | 6/1919 | Cirelli | 403/85 X |
| 1,318,257 | 10/1919 | Blaustein | 211/99 |
| 1,685,233 | 9/1928 | Jewett | 248/293 |
| 1,892,687 | 1/1933 | Teufel | 248/293 X |
| 2,546,493 | 3/1951 | Booth | 403/85 |
| 2,778,705 | 4/1954 | Barker . | |
| 3,086,657 | 12/1961 | Myers et al. . | |
| 3,285,423 | 11/1966 | Bar-Giora . | |
| 3,420,488 | 1/1969 | Sisler . | |
| 3,981,404 | 9/1976 | Goeke . | |
| 4,094,414 | 6/1978 | Thiot et al. . | |
| 4,171,748 | 10/1979 | Fahian . | |
| 4,771,895 | 9/1988 | Steiner . | |

FOREIGN PATENT DOCUMENTS

| | | | |
|---|---|---|---|
| 887851 | 1/1962 | United Kingdom | 211/105.1 |

*Primary Examiner*—J. Franklin Foss
*Attorney, Agent, or Firm*—Frank C. Price

[57] ABSTRACT

A collapsible hanger bar provides a simple and effective hanger device having three structural members joined by rivets. A U-shaped channel member is anchored to the wall and supports an elongate tubular member and an elongate bar member having a hooked shape at its far end. Erection involves the raising of the elongate tubular member and elongate bar member are from the vertical position until the hook portion of the flat bar is engageable with the open bore of the tubular member. The hook shape is then engaged with the open bore at the end of the elongate tubular member as the elongate tubular member and flat bar are pivoted downwardly to full engagement and into the erected position. To disengage, the elongate tubular member and flat bar are pivotally elevated to the point of disengagement, and then pivoted downward to the stored position.

2 Claims, 1 Drawing Sheet

COLLAPSIBLE HANGER BAR

BACKGROUND OF THE INVENTION

The present invention relates to collapsible devices used to hang objects, and more particularly to a collapsible bar foldable into an engaged position for enabling the hanging of clothes and garments and foldable to a disengaged position for more efficient utilization of space.

Within the living space provided to most people, the amount of closet space available is an important concern. Houses and apartments having ample closet space and garment hanging space will typically also have other large living spaces and will therefore be quite costly. Typically, ample closet and garment hanging space in an average sized living space will not be found.

As a result of this relationship between the size of the living space generally and the size and degree to which the closet space is equipped, modest sized living space will typically make available modest sized closet space. In the case where the closet space and therefore the garment hanging space is modest, it is particularly important to utilize such space in as efficient manner as possible.

From time to time ,the need for garment hanging space versus bulk space for storage will change. If garment hanging rods or bars are initially installed, it may be that later it is desirable to occupy the space taken up with the garment hanging rods or bars. If garment hanging rods or bars are not installed initially, it may bet that later it is desirable to have such garment hanging rods available for the temporary hanging of clothes and garments.

Specific device utilized for providing structures amenable to the hanging of clothes and garments have been known in the literature. For example, U. S. Pat. No. 2,778,705 discloses a cabinet having a rigid supporting bar. U.S. Pat. No. 3,420,488 discloses a rectangularly shaped wall mounted support. U.S. Pat. No. 3,285,423 discloses a wall bracket having a combined base and container. U.S. Pat. No. 3,981,404 discloses a telescoping garment hanger. U.S. Pat. No. 4,094,414 discloses a clothes hanging rack which also telescopes. U.S. Pat. No. 4,171,748 discloses a foldable hanger assembly. U.S. Pat. No. 4,771,895 discloses a telescopic clothes drier. U.S. Pat. No. 3,086,658 discloses an article of houseware for providing support.

All of the above devices have one or more shortcomings. Some of the devices are ineffective because they occupy too much space. Others may be ineffective because their structure is too complicated and therefore too expensive to construct. What is needed is a relatively strong sturdy structure which may be erected and utilized to hang clothing, garments, and other similar items, yet which can be un-erected to a position which will provide the maximum available bulk space.

Further, the needed device should have no sharp or other projections which might potentially damage clothing. The needed device should also have a configuration which is amenable to inexpensive construction and inexpensive raw materials cost. The needed device should also e of such design that a significant number of clothes, garments and other types of load producing items can be successfully and securely supported by the needed structure. The needed device should present a minimal intrusion into the space in which it occupies in its un-erected position.

BRIEF SUMMARY OF THE INVENTION

The present invention provides a simple and effective hanger device having three structural members joined by rivets. A U-shaped channel member supports an elongate tubular member and an elongate bar having a hooked shape at its far end. The elongate tubular member and elongate flat bar are raised from their vertical storage positions until the hook portion of the flat bar extends beyond the end of the tubular member. The hook shape at the end of the flat bar is then engages the end of the elongate tubular member as the elongate tubular member is brought downward toward horizontal position; the collapsible hanger bar of the present invention assuming the erected position. Disengagement of the elongate tubular member from the flat bar is accomplished by pivotally raising them to the point of disengagement, and then separately pivotally returning them to their vertical storage positions.

BRIEF DESCRIPTION OF THE DRAWINGS

Other aspects, features and advantages of the invention, its configuration, construction and operation will be best understood from the following detailed description, taken in conjunction with the accompanying drawings in which.

DETAILED DESCRIPTION OF THE PREFERRED EMBODIMENT

Figure 1:
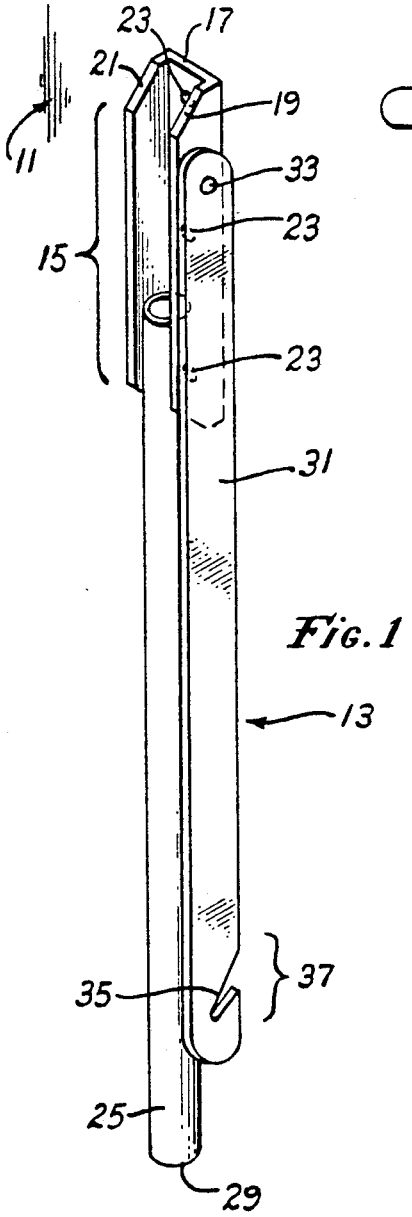
FIG. 1 a perspective view of the collapsible hanger bar of the present invention in the un-erected position shown affixed to a wall.
Figure 1A:
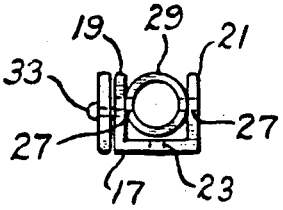
FIG. 1*a* is a top view of the collapsible hanger bar of the present invention in the un-erected position.

Referring to FIGS. 1 and 1*a*, the collapsible hanger of the present invention is illustrated attached to a wall 11. Such a wall may be of any type, including plaster, drywall, or concrete. Collapsible hanger 13 is in the un-erected position, and has a suspended profile. A channel member 15 has a base plate 17 and a pair of side plates 19 and 21. Channel member 15 is attached directly to wall 11 by any means, but especially by bolting or the use of screws through the base plate 17.

A series of apertures 23 are formed along the center of base plate 17 of channel member 15 to facilitate the attachment of channel member 15 to wall 11. In addition, other apertures 23 may be drilled into base plate 17 of channel member 15 as needed to provide additional apertures 23 for the anchoring of the channel member 15. Alternatively, the channel member 15 may be provided with no apertures 23, in order either that apertures 23 may be provided in both channel member 15 and wall 11, as needed, simultaneously, or some other method may be utilized for securing channel member 15 to wall 11.

Near the lower portion of channel member 15, an elongate tubular member 25 extends vertically downward. Elongate tubular member 25 is attached to the side plates 19 and 21 of channel member 15 by means of a pair of rivets 27 each of which extends from one side of channel member 15 through side plate 19 or side plate 21, and into one side of elongate tubular member 25.

Elongate tubular member 25 is enabled to pivot in the vertical plane, about the rivet 27 from a downward position, upward to an orientation significantly above the horizontal. The upward movement of elongate tubular member 25 may be limited by the closeness of attachment to base plate 17, and whether the round end of elongate tubular member has some material removed in order to provide clearance between base plate 17 and the portion of the closest point on the rim of the elongate tubular member 25. The end of elongate tubular member 25 opposite the end secured by rivet 27 is uncovered, exposing an internal bore 29.

A generally flat bar 31 is attached to the side of side plates 19 of channel member 15 by riveting with a rivet 33. Similar to elongate tubular member 25, flat bar 31 is enabled to pivot in a vertical plane, about rivet 33 from a downward position, upward completely to a vertical upward position, since no other pieces or members inhibit its movement.

The end of flat bar 31 has a slot 35 angularly cut into it at an angle forming a hook type structure 37. The angle and depth of slot 35 is matched to engage the open bore 29 of elongate tubular member 25, when elongate tubular member 25 is in the horizontal position. Of course, this angle and depth is also dependent upon both the length and height of attachment of flat bar 31 with respect to the point of attachment of elongate tubular member 25 to channel member 15.

From FIGS. 1 and 1*a*, it is clear that elongate tubular member 25 and flat bar 31 are pivotal within different vertical planes. This is especially so since flat bar 31 is pivotally attached to one side of side plate 19 while the elongate tubular member 25 is pivotally attached to the other side of side plate 19.

Figure 2:
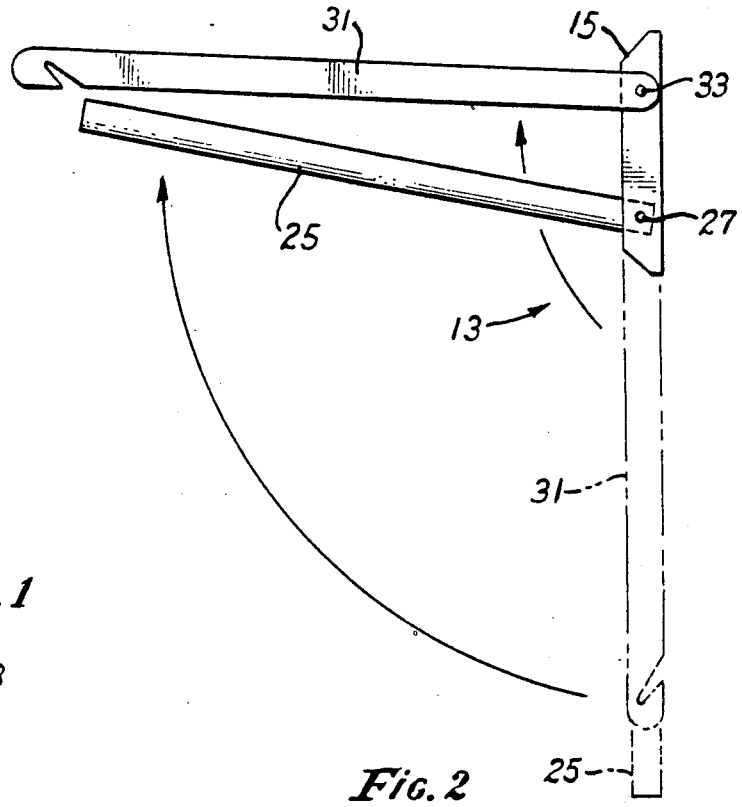
FIG. 2 is a side view of the collapsible hanger bar shown in FIG. 1 being manipulated in preparation for engagement to the erected position.
Figure 3:
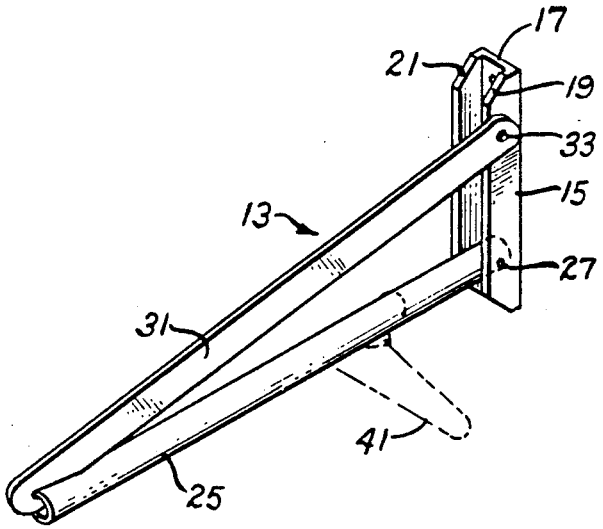
FIG. 3 is a perspective view of the collapsible hanger bar of FIGS. 1 and 2 in the erected position.

The operation of the collapsible hanger bar 13 of the present invention is best illustrated by reference to FIGS. 2 and 3 in addition to FIGS. 1 and 1*a*. FIGS. 2 and 3 illustrate the erection of the collapsible hanger bar 13 into a position to facilitate the hanging of garments.

Referring to FIG. 2, it is apparent that the elongate tubular member 25 and the flat bar 31 have been pivoted upwardly from their vertical position. Elongate tubular member 25 is pivoted upwardly to an angle greater than horizontal, while flat bar 31 is pivoted upwardly to an angle which may be a little less than or a little more than horizontal depending upon the dimensions of collapsible hanger bar 13, including the lengths of the elongate tubular member 25 and the flat bar 31, and the vertical separation of their points of attachment to channel member 15.

As the elongate tubular member 25 and the flat bar 31 are raised, their ends, and in particular the hook type structure 37 of flat bar 31, and the open bore 29 of elongate tubular member 25 are brought into proximity with each other. This is possible because the flat bar 31 may be very slightly bent to intersect the pivotal plane of elongate tubular member 25, to such an extent as to bisect the center of elongate tubular member 25 enough to allow the tip end of the hook type structure 37 to be inserted inside of bore 29.

Alternately, it is clear that once the ends, and in particular the hook type structure 37 of flat bar 31, and the open bore 29 of elongate tubular member 25 are brought into proximity with each other, the slot 35 of flat bar 31 may be aligned with an edge of the end of elongate tubular member 25. Once this alignment takes place, the elongate tubular member 25 and the flat bar 31 are angularly lowered causing the end of elongate tubular member 25 to enter the slot 35 and causing the hook type structure 37 of flat bar 31 to engage the bore 29 of the elongate tubular member 25.

Once the end of elongate tubular member 25 has reached the closed end of the slot 35, the downward motion of both the flat bar 31 and the elongate tubular member 25 is stopped. Any further downward force upon elongate tubular member 25 is translated into a horizontal compression force against the base of elongate tubular member 25 against channel member 15, and a tensile force by flat bar 31 away from channel member 15. Since channel member 15 is securely attached to wall 11, a stable, sturdy structure, namely that formed by the horizontal hanger bar 13 results.

Garments and other suspended items may then be hung by engagement with the now horizontal elongate tubular member 25. A clothes hanger 41 is illustrated in FIG. 3 to show how best to use the horizontal hanger bar 13 once it has been erected into position. Due to the lengths of both flat bar 31 and elongate tubular member 25 the slight bending of those members to align their ends causes no detrimental effects. The elongate tubular member 25 may now be fully loaded with clothes, garments and other suspended items.

To return the hanger bar 13 of the present invention to its non-erected position, all suspended items are removed from the elongate tubular member 25. Then, both the elongate tubular member 25 and the flat bar 31 are pivotally raised together until the hook type structure 37 becomes disengaged from the inside of bore 29. Once disengagement occurs, the elongate tubular member 25 and the flat bar 31 may be independently pivoted downward to their vertical storage positions.

One of the advantages of the hanger bar 13 described herein is the simplicity of construction and the simplicity of the materials from which it is made. In the preferred embodiment, channel member 15 is designed to have a separation between side plates 19 and 21 sufficient to accommodate a nominal one half inch tube, having about an 0.705 inch outer diameter. Channel member 15 is typically about 15 inches long, and has a distance of separation between the points of attachment of the elongate tubular member 25 and the flat bar 31 to channel member 15 of about 10.6 inches. Channel member 15 may be any from 16–20 gauge metal and is preferably made of 20 gauge zinc plated steel, and may have a painted finish or powder coat finish, as may also be the case for flat bar 31 or elongate tubular member 25.

The preferred embodiments of hanger bar 13 include a first length of flat bar 31 which is about 3 feet long, and a second length of flat bar 31 which is about 4 feet long, used to construct what are known nominally as the 3 foot model and the 4 foot model. Flat bar 31, in the preferred embodiments, is about 0.75 inches wide and about one eighth of an inch thick. The slot 35 is preferably from about 0.10 inches to about 0.125 inches wide. Slot 35 has a closed end at the center of the flat bar 31, and extends toward the other end of the bar, and toward the edge of the flat bar 31 at an angle of 15° with respect to a line taken down the center of the flat bar 31. Flat bar 31 is preferably aluminum such as 6061 aluminum alloy.

The elongate tubular member 25 is about 34 inches long for the nominal 3 foot model and about 46.25 inches long for the nominal 4 foot model. The elongate tubular member 25 has an external diameter of from about 0.5 inches to about 1.0 inches, but is preferably about one half inch nominal which translates to an outer diameter of about 0.705 inches. This further translates into a wall thickness of about 0.1 inches. The holes drilled in both the elongate tubular member 25 and the flat bar 31 are size No. 30 holes, and accommodate rivets 33 and 27 which, in the preferred embodiment are one eighth inch self plugging rivets. The rivets 33 and 27 are preferably aluminum rivets with aluminum mandrels. One such self plugging rivet is known as the Cherry Q Rivet, and is made by the Cherry division of Textron, Inc.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed is:

1. A collapsible hanger bar comprising:

wall anchoring member means for attachment to a planar surface and for providing pivotal support;

an elongate tubular member having a first end pivotally supported by said wall anchoring member for pivotal movement in a vertical plane, and a second end having an open bore; and a flat bar, having a first end pivotally supported by said wall anchoring member for pivotal movement generally in a vertical plane, and a second end having an angled slot, said angled slot fittably engageable with said open bore.

2. A collapsible hanger bar, the combination of a vertical wall-mounted member, the hanger bar, and a sloped support bare above the hanger bar connecting the hanger bar and the wall-mounted member thus holding the hanger bar horizontal, the hanger bar pivotally attached to the wall-mounted member, the improvement comprising:

the wall-mounted member being a "U" shape in cross section with the base of the "U" mounted against the wall, the width of the hanger bar being sized to fit inside the "U" of the wall-mounted member, the hanger bar pivotally attache at its one end within the "U" at a location low on the wall-mounted member, the end of the hanger bar not pivotally attached having an open bore, the hanger bar pivotable downward to a vertical position with protrusion vertically downward out of the trough of the "U", the support bar being simple flat solid shape pivotally attached to the outside of one of the walls of the "U" of the wall-mounted member, the support bar hanging in a vertical position along the wall and along the hanger bar when the hanger bar is not erected for use, the support bar having an angled slot near its end opposite the pivot end, the slot connecting the support bar in a hypotenuse position to the open, non-pivoted end of the hanger bar as the wall of the open end of the hanger bar jams into the slot of the support bar, the result being a fixed, functional, horizontal position for the hanger bar when it is in use to accept objects for hanging, the result being a three-piece hanger bar combination which, when not in use, collapses with all three pieces positioned together hanging downwardly along the wall.

* * * * *